US007762797B2

(12) United States Patent
Wu

(10) Patent No.: US 7,762,797 B2
(45) Date of Patent: Jul. 27, 2010

(54) PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 909 days.

(21) Appl. No.: 11/563,482

(22) Filed: Nov. 27, 2006

(65) Prior Publication Data

US 2007/0148021 A1 Jun. 28, 2007

Related U.S. Application Data

(63) Continuation-in-part of application No. 11/306,320, filed on Dec. 22, 2005, now abandoned.

(51) Int. Cl.
*F04B 39/12* (2006.01)
*F01B 31/00* (2006.01)

(52) U.S. Cl. ..... 417/572; 92/58.1

(58) Field of Classification Search ..... 417/572; 92/58.1

See application file for complete search history.

(56) References Cited

U.S. PATENT DOCUMENTS

| | | | | |
|---|---|---|---|---|
| 4,569,275 | A * | 2/1986 | Brunet | 92/58.1 |
| 5,676,529 | A | 10/1997 | Hermansen et al. | 417/259 |
| 6,779,536 | B2 * | 8/2004 | Kuo | 135/24 |
| 2003/0110936 | A1 * | 6/2003 | Chuang | 92/15 |
| 2003/0194336 | A1 | 10/2003 | Wu | 417/559 |
| 2005/0008500 | A1 | 1/2005 | Huang et al. | 417/572 |

OTHER PUBLICATIONS

Taiwanese Patent No. M267345, Jun. 11, 1994, 8 pages.

* cited by examiner

*Primary Examiner*—Charles G Freay
(74) *Attorney, Agent, or Firm*—Alan Kamrath; Kamrath & Associates PA

(57) ABSTRACT

A pump includes a cylinder, a nozzle connected to an end of the cylinder, a piston movable in the cylinder, a rod connected to the piston, a ring installed at another end of the cylinder, a positioning device connected to the rod and a handle. The handle includes a connective portion for engagement with the positioning device when the rod is exposed from the handle.

12 Claims, 12 Drawing Sheets

4 - 4

3 - 3

12-12

16-16

PUMP

CROSS-REFERENCE

The present application is a continuation-in-part application of U.S. patent application Ser. No. 11/306,320 filed on Dec. 22, 2005, now abandoned.

BACKGROUND OF INVENTION

1. Field of Invention

The present invention relates to a pump and, more particularly, to a compact pump.

2. Related Prior Art

Disclosed in Taiwanese Patent M267345 is a conventional pump. This conventional pump includes a cylinder 10 and a handle 30. The handle 30 always extends beyond the cylinder 10 whether the pump is in use or not. The handle 30 occupies a lot of space in addition to what the cylinder 10 occupies. The shortest length of the pump is the length of the handle 30 plus that of the cylinder 10. The pump is bulky and causes inconvenience for a user trying to store it.

The present invention is therefore intended to obviate or at least alleviate the problems encountered in the prior art.

SUMMARY OF INVENTION

According to the present invention, a pump includes a cylinder, a nozzle connected to an end of the cylinder, a piston movable in the cylinder, a rod connected to the piston, a ring installed at another end of the cylinder, a positioning device connected to the rod and a handle. The handle includes a connective portion for engagement with the positioning device when the rod is exposed from the handle.

The primary advantage of the pump of the present invention is that when the pump is not in use, the handle shields the cylinder so that the entire pump occupies little space and can conveniently be stored.

Other advantages and features of the present invention will become apparent from the following description referring to the drawings.

BRIEF DESCRIPTION OF DRAWINGS

The present invention will be described through detailed illustration of two embodiments referring to the drawings.

DETAILED DESCRIPTION OF EMBODIMENTS

Figure 1:
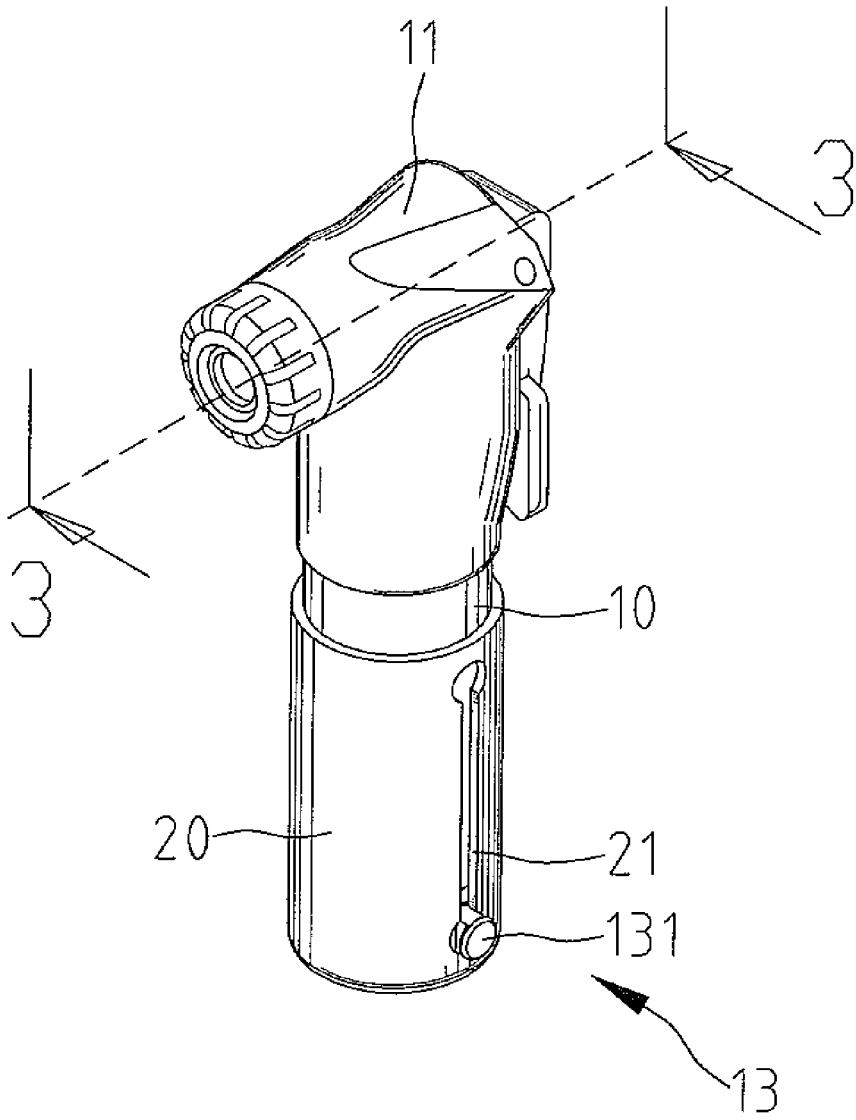
FIG. 1 is a perspective view of a pump according to the first embodiment of the present invention.
Figure 2:
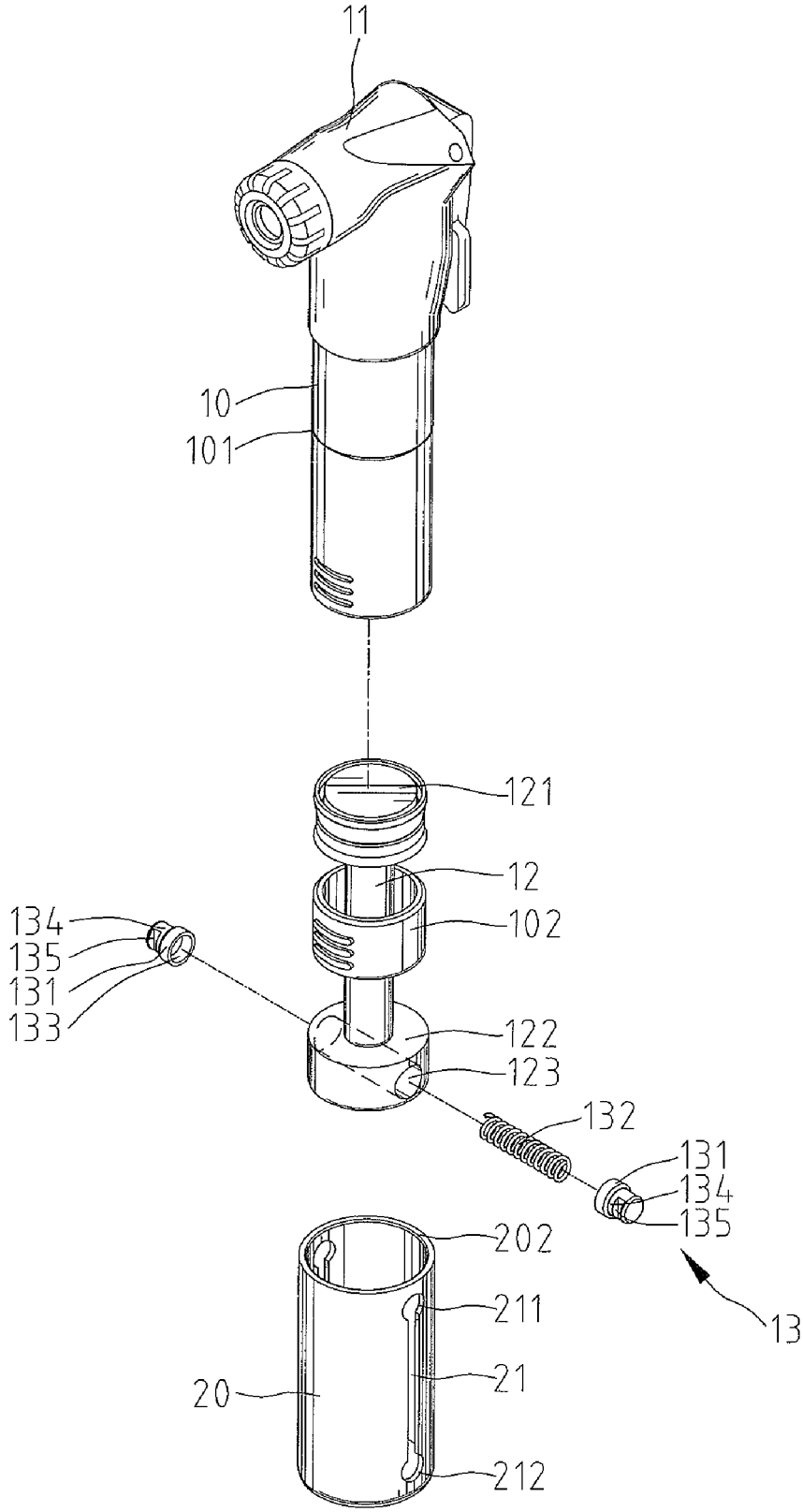
FIG. 2 is an exploded view of the pump shown in FIG. 1.

Referring to FIGS. 1 through 9, according to a first embodiment of the present invention, a pump includes a cylinder 10, a nozzle 11 connected to an end of the cylinder 10, a piston 121 positioned in the cylinder 10, a rod 12 connected to the piston 121, a ring 102 connected to an opposite end of the cylinder 10 to retain the piston 121 in the cylinder 10, a connector 122 connected to the rod 12 and a handle 20 connected to the connector 122.

A positioning device 13 is connected to the connector 122. The positioning device 13 includes two detents 131 and an elastic element 132 compressed between the detents 131. Each of the detents 131 includes a first portion 133, a second portion 134 on the first portion 133, a third portion 135 on the second portion 134 and a fourth portion on the third portion 135. The second portion 134 is thicker than the third portion 135. The diameter of the second portion 134 is equal to that of the fourth portion. The first portion 133 is hollow for receiving an end of the elastic element 132. The first portion 133 is thicker than the second portion 134. The elastic element 132 and the first portions 133 of the detents 131 are inserted in a tunnel 123 defined in the connector 122.

The handle 20 defines two slots 21. Each of the slots 21 is in communication with an upper aperture 211 at an end and in communication with a lower aperture 212 at another end. The diameter of the apertures 211 and 212 is marginally larger than that of the second portions 134 of the detents 131. The width of the slots 21 is marginally larger than that of the third portions 135 of the detents 131.

An annular ridge 101 is formed on an external side of the cylinder 10. An annular ridge 202 is formed on an internal side of the handle 20.

Figure 4:
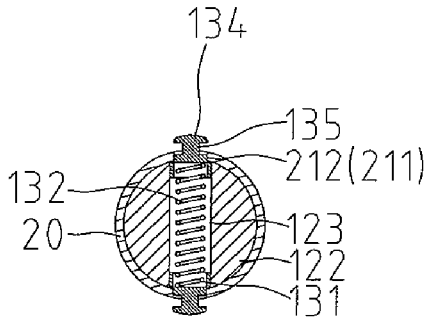
FIG. 4 is a cross-sectional view of the pump taken along a line 4-4 shown in FIG. 3.
Figure 3:
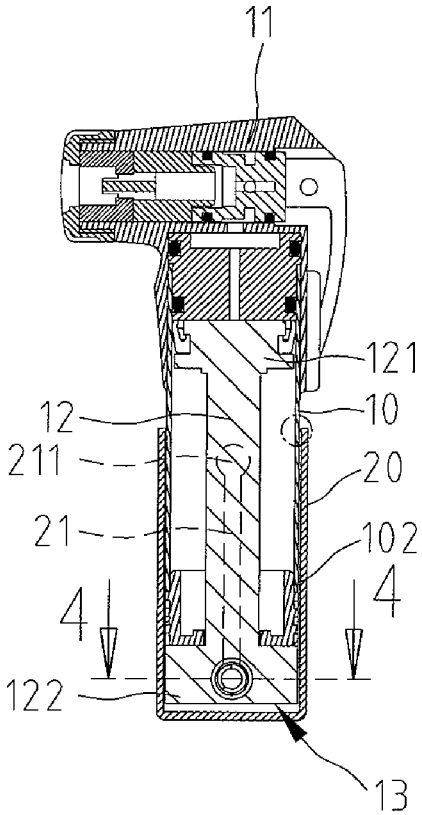
FIG. 3 is a cross-sectional view of the pump taken along a line 3-3 shown in FIG. 1.
Figure 5:
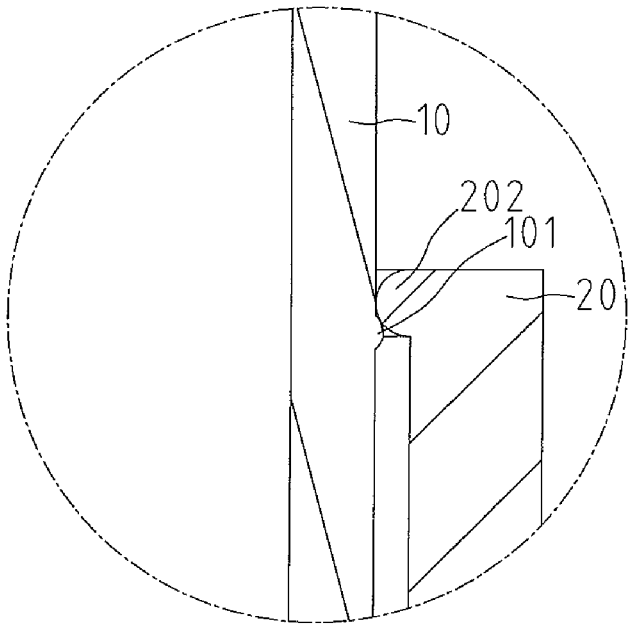
FIG. 5 is an enlarged partial view of the pump shown in FIG. 3.

Referring to FIGS. 3 through 5, the pump is in a collapsed position for storage or transportation. The cylinder 10 is inserted in the handle 20 so that the pump occupies only a little space. The second portions 134 of the detents 131 are trapped in the lower apertures 212. The annular ridge 101 is engaged with the annular ridge 202.

Figure 7:
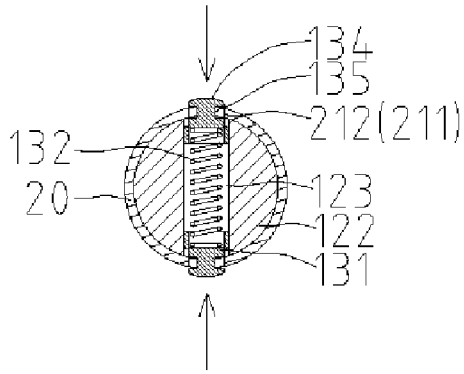
FIG. 7 is a cross-sectional view of the pump taken along a line 7-7 shown in FIG. 6.
Figure 6:
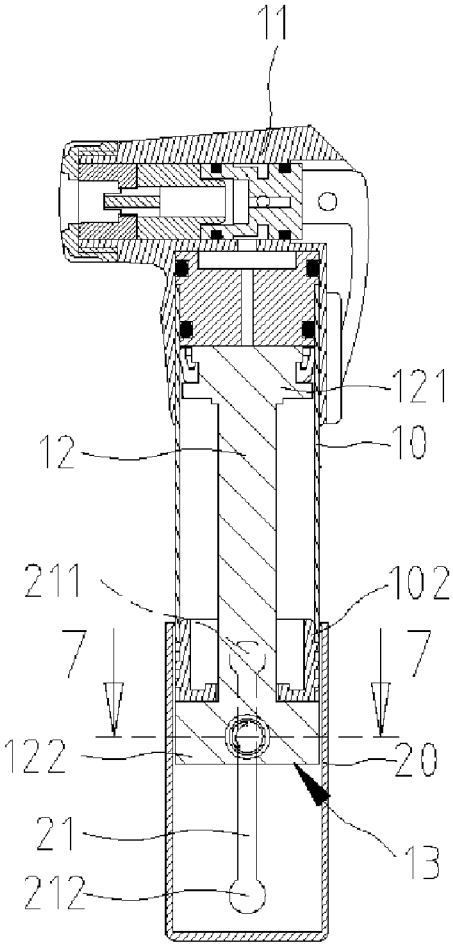
FIG. 6 is a cross-sectional view of the pump where a handle is in another position than shown in FIG. 3.

Referring to FIGS. 6 and 7, the detents 131 are pushed so that the third portions 135 thereof are movable along the slots 21. Thus, the pump can be extended, i.e., the cylinder 10 can be extended from the handle 20.

Figure 8:
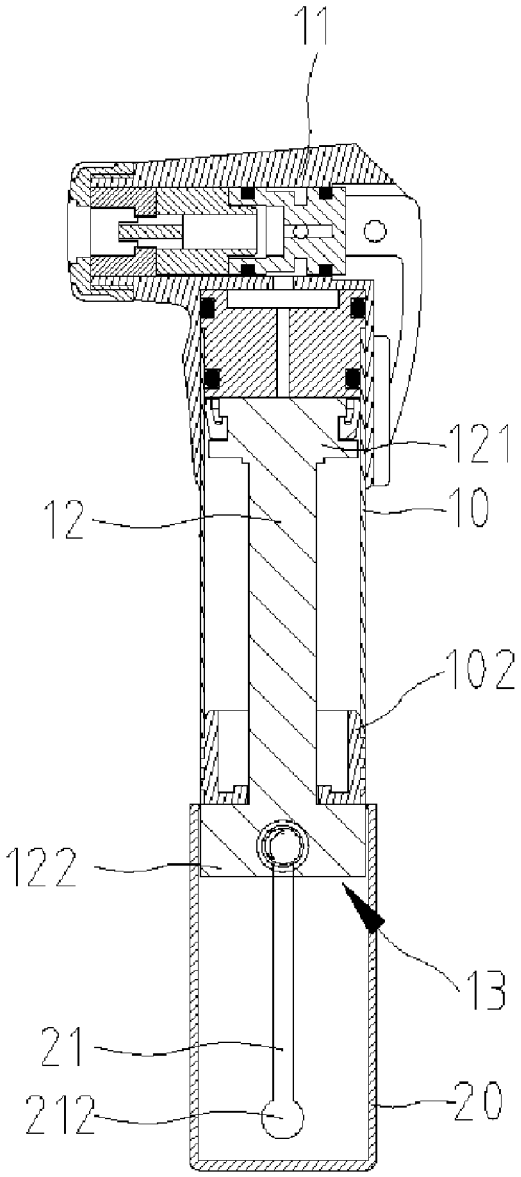
FIG. 8 is a cross-sectional view of the pump where a handle is in another position than shown in FIG. 6.

Referring to FIG. 8, the pump is in an extended position for use. The rod 12 is exposed from the handle 20. The second portions 134 of the detents 131 are trapped in the upper apertures 211 so that the pump is retained in the extended position.

Figure 9:
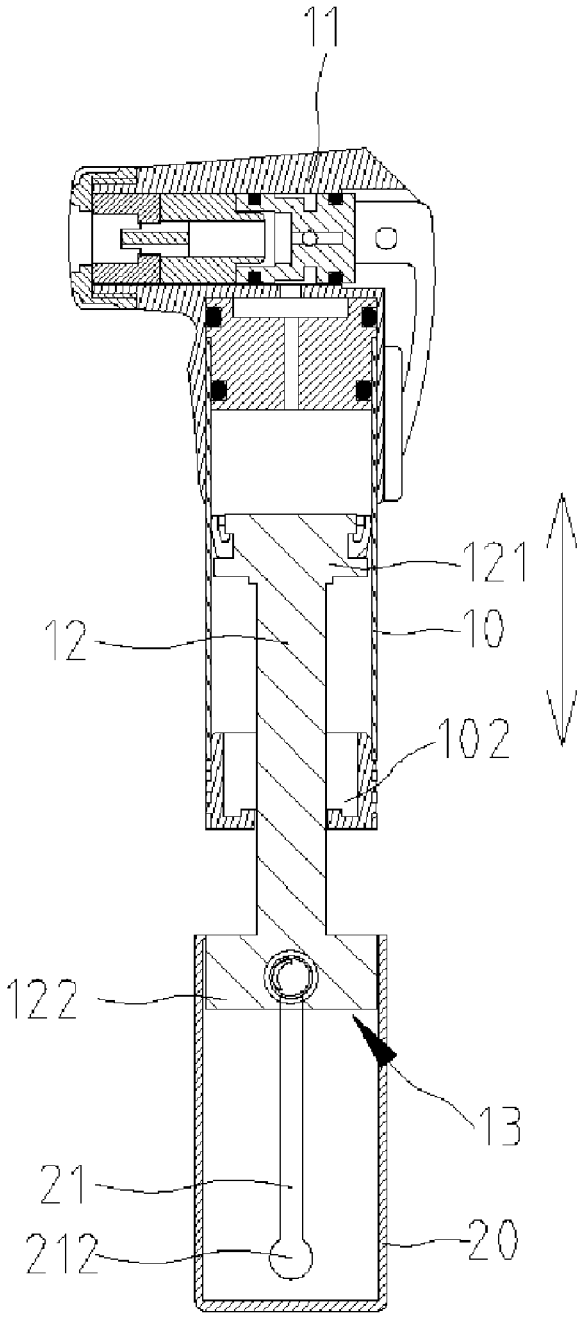
FIG. 9 is a cross-sectional view of the pump where a piston is in another position than shown in FIG. 8.
Figure 10:
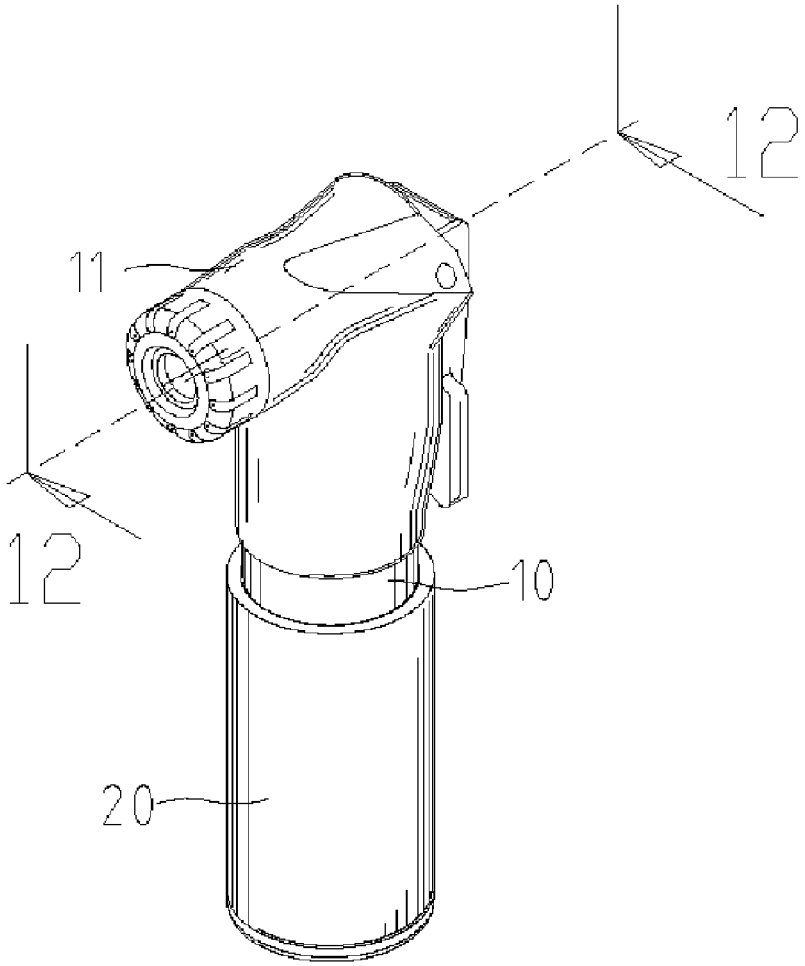
FIG. 10 is a perspective view of a pump according to the second embodiment of the present invention.
Figure 11:
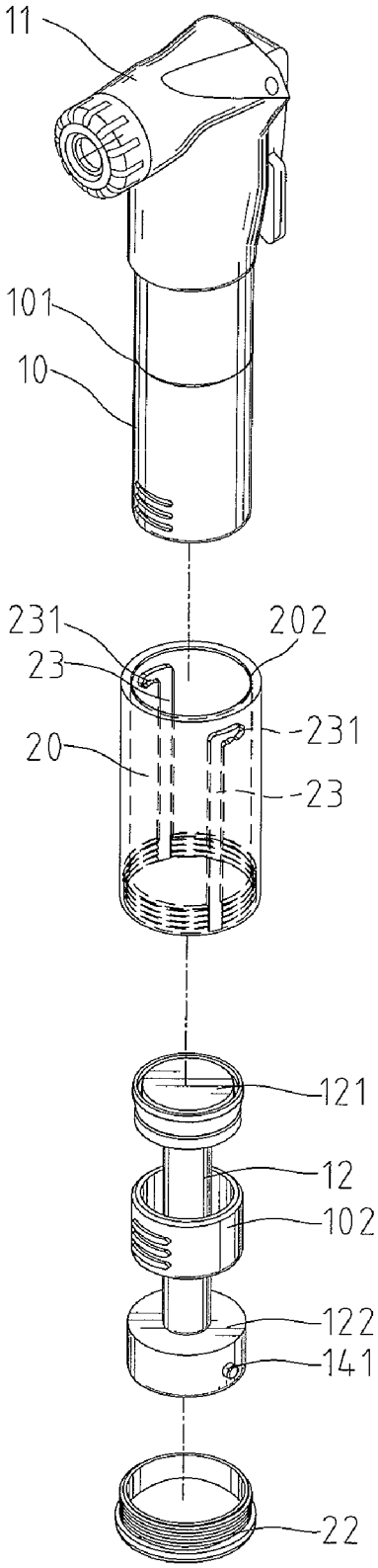
FIG. 11 is an exploded view of the pump shown in FIG. 10.

Referring to FIG. 9, to pump, the piston 121 is reciprocated in the cylinder 10 by manipulating the handle 20.

Referring to FIGS. 10 through 17, there is shown a pump according to a second embodiment of the present invention. The second embodiment is like the first embodiment except several things. Firstly, two bosses 141 are formed on the connector 122. Secondly, two longitudinal grooves 23 are defined in an internal side of the handle 20. Each of the longitudinal grooves 23 is in communication with a transverse groove 231 at an upper end. Thirdly, the handle 20 is a tube engaged with a cap 22 at an end.

Figure 13:
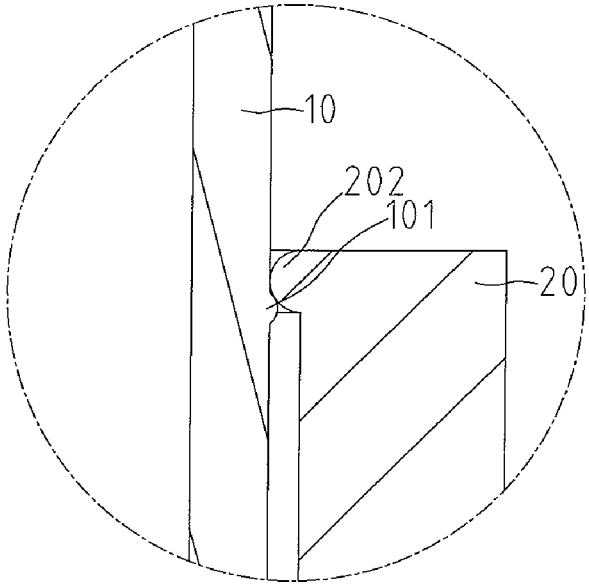
FIG. 13 is an enlarged partial view of the pump shown in FIG. 12.
Figure 12:
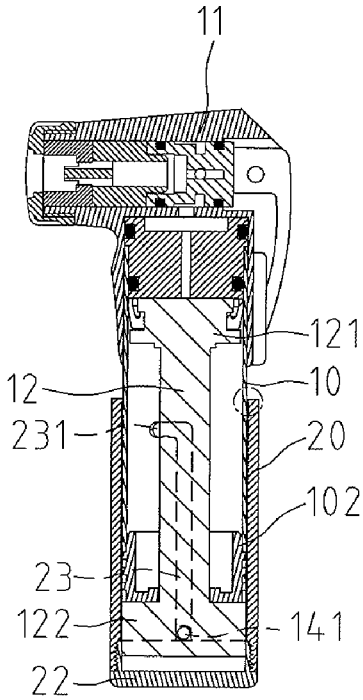
FIG. 12 is a cross-sectional view of the pump taken along a line 12-12 shown in FIG. 10.

Referring to FIGS. 12 and 13, the pump is in a collapsed position for storage or transportation. The cylinder 10 is inserted in the handle 20 so that the pump occupies only a little space. The annular ridge 101 is engaged with the annular ridge 202.

Figure 14:
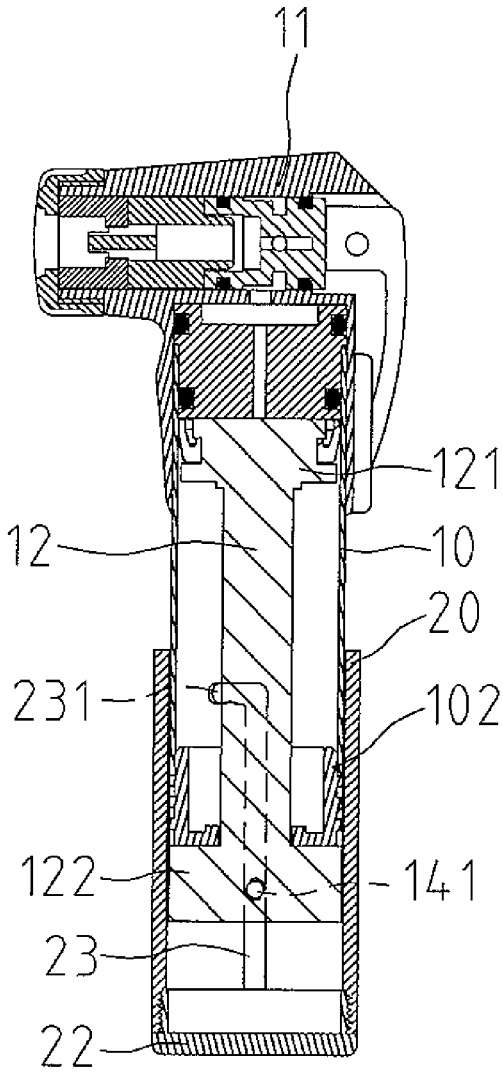
FIG. 14 is a cross-sectional view of the pump where a handle is in another position than shown in FIG. 12.

Referring to FIG. 14, the cylinder 10 is turned relative to the handle 20 so that the bosses 141 are disposed in and movable along the longitudinal grooves 23. Thus, the cylinder 10 can be extended from the handle 20.

Figure 16:
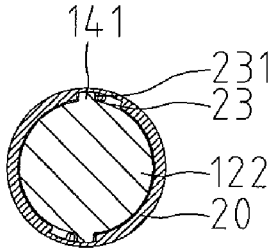
FIG. 16 is a cross-sectional view of the pump taken along a line 16-16 shown in FIG. 15.
Figure 15:
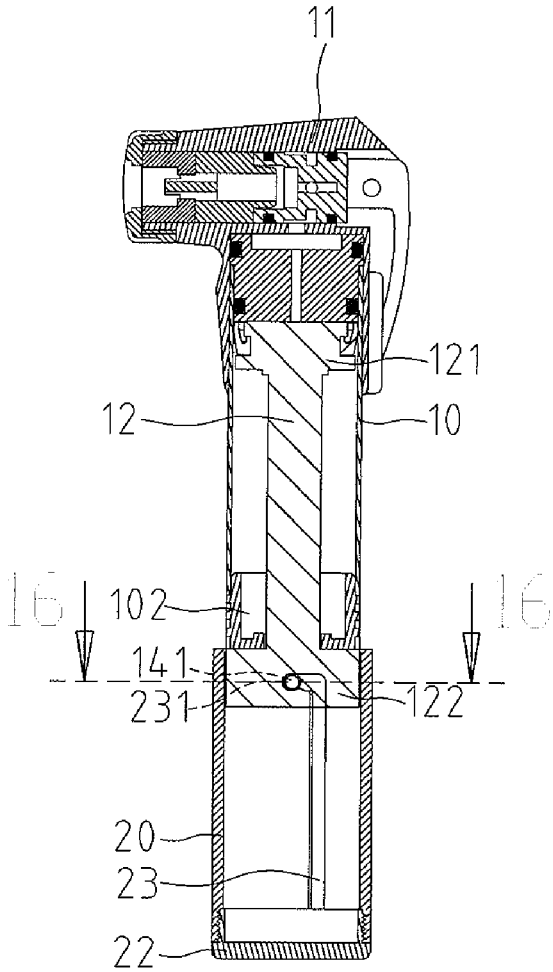
FIG. 15 is a cross-sectional view of the pump where the handle is in another position that shown in FIG. 14.

Referring to FIG. 15 and 16, the pump is in an extended position for use. The rod 12 is exposed from the handle 20. The bosses 141 are disposed in the transverse grooves 231 so that the pump is retained in the extended position.

Figure 17:
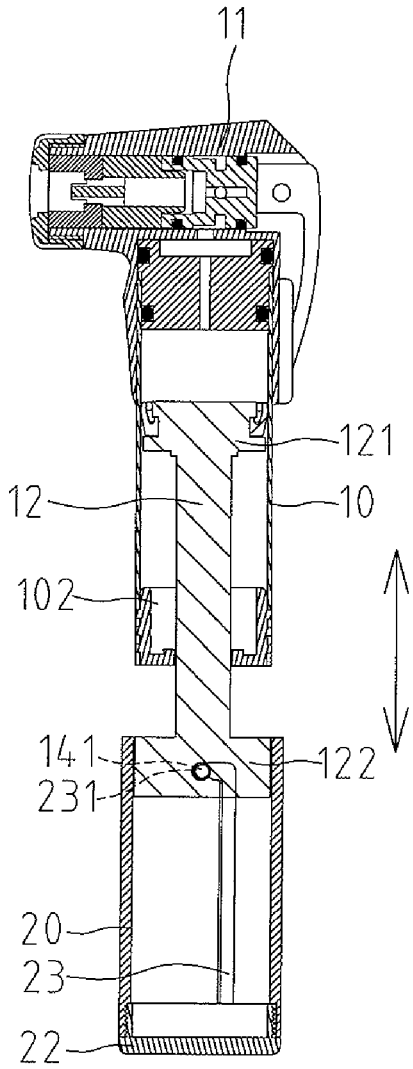
FIG. 17 is a cross-sectional view of the pump where a piston is in another position than shown in FIG. 15.

Referring to FIG. 17, to pump, the piston 121 is reciprocated in the cylinder 10 by manipulating the handle 20.

In another embodiment, each of the longitudinal grooves 23 may be in communication with another transverse groove 231 at a lower end for receiving the boss 141 when the cylinder 10 is inserted in the handle 20.

In still another embodiment, the transverse grooves 231 may be replaced with recesses while the longitudinal grooves 23 are omitted.

The pump of the present invention exhibits at least two advantages. Firstly, when the pump is not in use, the handle shields the cylinder so that the pump occupies little space. Secondly, switching of the pump between the extended and collapsed positions is easy. Thirdly, the pump can firmly be retained in the extended position in use.

The present invention has been described through the illustration of the embodiments. Those skilled in the art can derive variations from the embodiments without departing from the scope of the present invention. Therefore, the embodiments shall not limit the scope of the present invention defined in the claims.

What is claimed is:

1. A pump comprising:

a cylinder;

a nozzle connected to an end of the cylinder;

a piston movable in the cylinder;

a rod connected to the piston;

a ring installed at another end of the cylinder;

a positioning device connected to the rod; and a handle comprising a first connective portion for engagement with the positioning device when the rod is in a first position relative to the handle and a second connective portion for engagement with the positioning device when the rod is in a second position relative to the handle and different from the first position;

wherein the positioning device comprises a detent, wherein the first and second connective portions of the handle are apertures for receiving the detent, wherein the handle defines a slot in communication with the apertures at two ends, and wherein the width of the slot is smaller than the diameter of the apertures.

2. The pump according to claim 1 wherein the positioning device comprises another detent, and wherein the first connective portion of the handle further includes other apertures for receiving the other detent.

3. The pump according to claim 2 wherein the positioning device comprises an elastic element compressed against the other detent.

4. The pump according to claim 3 wherein the positioning device defines a tunnel for receiving the elastic element and the other detent.

5. The pump according to claim 1 wherein the positioning device comprises an elastic element compressed against the detent.

6. The pump according to claim 5 wherein the positioning device defines a tunnel for receiving the elastic element and the detent.

7. The pump according to claim 1 wherein the detent comprises a thick portion normally trapped in a selective one of the apertures and a thin portion for movement along the slot when pushed.

8. A pump comprising:

a cylinder comprising an annular ridge;

a nozzle connected to an end of the cylinder;

a piston movable in the cylinder;

a rod connected to the piston;

a ring installed at another end of the cylinder;

a connector connected to the rod and formed with a connective portion; and a handle comprising a first connective portion for engagement with the connective portion of the connector when the rod is in a first position relative to the handle, wherein the handle further comprises an annular ridge for engagement with the annular ridge of the cylinder when the cylinder is inserted into the handle.

9. The pump according to claim 8 wherein the connective portion of the connector is a boss, and the first connective portion of the handle is a recess for receiving the boss.

10. The pump according to claim 8 wherein the handle comprises a second connective portion for engagement with the connective portion of the connector when the rod is in a second position relative to the handle and different than the first position.

11. The pump according to claim 10 wherein the connective portion of the connector is a boss, and the second connective portion of the handle is a recess for receiving the boss.

12. The pump according to claim 11 wherein the recess is a transverse groove, and wherein the handle defines a longitudinal groove in communication with the transverse groove so that the boss can be moved from the transverse groove into the longitudinal groove.

* * * * *